United States Patent [19]

Robinson et al.

[11] Patent Number: 4,675,686

[45] Date of Patent: Jun. 23, 1987

[54] FLOTATION BAG ASSEMBLY

[75] Inventors: Tyler C. Robinson, Westwood; Wayne J. Sula, Elmwood; Roger C. Larson, Bridgewater; William J. Wallace, Plymouth, all of Mass.

[73] Assignee: Hazeltine Corporation, Commack, N.Y.

[21] Appl. No.: 831,129

[22] Filed: Feb. 20, 1986

Related U.S. Application Data

[63] Continuation of Ser. No. 561,765, Dec. 15, 1983.

[51] Int. Cl.[4] ..... H01Q 1/34

[52] U.S. Cl. ..... 343/709; 441/30

[58] Field of Search ..... 343/709, 710; 441/21, 441/30, 28

[56] References Cited

U.S. PATENT DOCUMENTS

| | | | |
|---|---|---|---|
| 3,093,808 | 6/1963 | Tatnall et al. | 343/709 |
| 3,500,209 | 3/1970 | Fletcher et al. | 343/709 |
| 4,353,071 | 10/1982 | Bernstein et al. | 343/709 |

FOREIGN PATENT DOCUMENTS

| | | | |
|---|---|---|---|
| 0047667 | 4/1977 | Japan | 343/710 |

*Primary Examiner*—Eli Lieberman

*Attorney, Agent, or Firm*—E. A. Onders; F. R. Agovino

[57] ABSTRACT

An apparatus for the stable support of a structure, such as an antenna, in a fluid medium, such as the ocean. A flotation bag supporting an antenna is stabilized by the following features, which can be used individually or in combination. A partially submerged ribbon fence supported by a submerged damper skirt dissipates the kinetic energy of the flotation bag caused by the movement of the ocean and water that encroaches upon the bag. A flexible connection between the bag and the payload enables the bag and the payload to undergo limited motion without affecting each other. Thus, the bag's motion is decoupled and totally independent of the payload. The housing which supports the payload has a flooded chamber, lowering the center of mass of the apparatus. The bottom of the flotation bag is inwardly arched, moving the bouyancy away from the center of the bottom of the bag, enhancing stability and allowing the bag to float lower in the ocean, keeping the damper skirt submerged. The payload includes an r.f. signal source. The apparatus is designed to constrain the motion of the antenna to within very narrow operational limits.

17 Claims, 11 Drawing Figures

ANTENNA SYSTEM PERFORMANCE
VS SEA STATE
HEAVE AND PITCH

HEAVE 5" PITCH 0°

HEAVE 5" PITCH 15°

HEAVE AND PITCH PERFORMANCE LIMIT

HEAVE 4" PITCH 0°

HEAVE 4" PITCH 15°

HEAVE 4" PITCH 25°

HEAVE 4" PITCH 45°

STATIC HEAVE 0" PITCH 0°

FLOTATION BAG ASSEMBLY

The Government has rights in this invention pursuant to Contract N00039-83-C-0191 awarded by the Department of the Navy.

This is a continuation of application Ser. No. 06/561,765 filed Dec. 15, 1983, now abandoned.

BACKGROUND OF THE INVENTION

1. Field of Invention

This invention relates generally to a stable support for structures at or above the surface of a fluid medium and in particular to a communications buoy for use in the ocean.

2. Description of the Prior Art

Many types of floation devices exist with differing characterisitcs.

Damper plates and toroid shaped flotation devices have been used to create buoys which are wave followers. For example, see *Buoy Engineering,* H. O. Berteaux, John and Sons, 1976 Pg. 212–213. These surface following buoys are subject to strong heave and pitch due to the motion of the ocean.

A more stable buoy can be built by decreasing the cross section of the buoy at the water level. Such devices experience less heave. The mass of the buoy can also be distributed to create a righting moment. This will decrease the pitch.

Further stability can be obtained by surface decoupling. A bouyant cylinder with a counterweight suspended from its bottom is a typical example, Berteaux, supra. Such spar buoys cannot have much reserve bouyancy and usually have a large draft. These factors mitigate the usefulness of these types of buoys in deep water.

SUMMARY OF THE INVENTION

It is an object of this invention to provide a communications buoy having an antenna which uses the surface of the ocean as a ground plane; such bouy having structure which limits the antenna's motion with respect to the surface of the ocean to within 4 inches heave and 25° pitch.

It is another object of this invention to provide a stable bouy that can withstand ocean conditions up to and including state 5.

The buoy according to the invention may be used as part of a search and rescue system for locating downed aircraft and ships in distress. Such buoys would be carried by vehicles and be deployed when needed. Their distress signal could be received by satellites and their position located.

The buoy according to the invention could carry various other types of payloads or support various antenna structures as well. Other possible uses include oceanographic monitoring bueys and satellite linked sonobuoys.

It is an object of this invention to provide an apparatus for the stable support of a structure, such as an antenna, in a fluid medium, such as water.

It is a further object of this invention to limit the motion of an antenna supported above the surface of the ocean, within the operational limits of the transmitting system.

It is a further object of this invention to support an electronics payload near the surface of the ocean such that the power loss between the electronics payload and an antenna supported on the surface is within operational limits and, specifically, less than 3 db.

The invention is an apparatus for the stable support of a structure, such as an antenna, in a fluid medium, such as water. The apparatus comprises a bouyant first member and first means for engaging the structure. The first means is associated with the member. Second means are provided for channeling the fluid which encroaches upon the bouyant member due to any motion of the member with respect to the surface of the fluid medium, the encroaching fluid being channeled back into the fluid medium such that the kinetic energy of the bouyant first member is dissipated as the fluid is channeled back into the fluid medium.

Alternatively, the apparatus according to the invention may comprise a bouyant first member for supporting the structure, a payload and decoupling means for supporting the payload below the bouyant member such that any motion of the payload is decoupled from the member and any motion of the member is decoupled from the payload.

Alternatively, the apparatus according to the invention may comprise a bouyant member with an inwardly arched bottom portion, and means, associated with the bouyant member, for engaging the structure.

Alternatively, an apparatus according to the invention may comprise an antenna, a bouyant member, first means for generating an r.f. signal, second means interconnecting the first means and the antenna, and decoupling means for supporting the first means below the bouyant member such that any motion of the member is decoupled from the first means and the motion of the first means is decoupled from the member.

Alternatively, the invention may comprise a communications bouys which is stable in a fluid medium and includes structures for minimizing the heave and pitch of the bouy. Specifically, a flotation bag with a concave bottom formed by pulling in the center of the bottom of the bag with straps secured to the inside walls of the bag supports an antenna. A semi-rigid damper skirt extending around the base of the bag is submerged when the apparatus is floating in the fluid medium. The bag is provided with a ribbon fence comprising containers which have an opening above the fluid level, and an opening below the fluid level, when the apparatus is floating in the medium, allowing the fluid to flow in and out of the containers. The payload is supported in a cylindrical chamber connected to the flotation bag by a flexible cable, enabling the payload to swing.

DETAILED DESCRIPTION OF THE INVENTION

Figure 1:
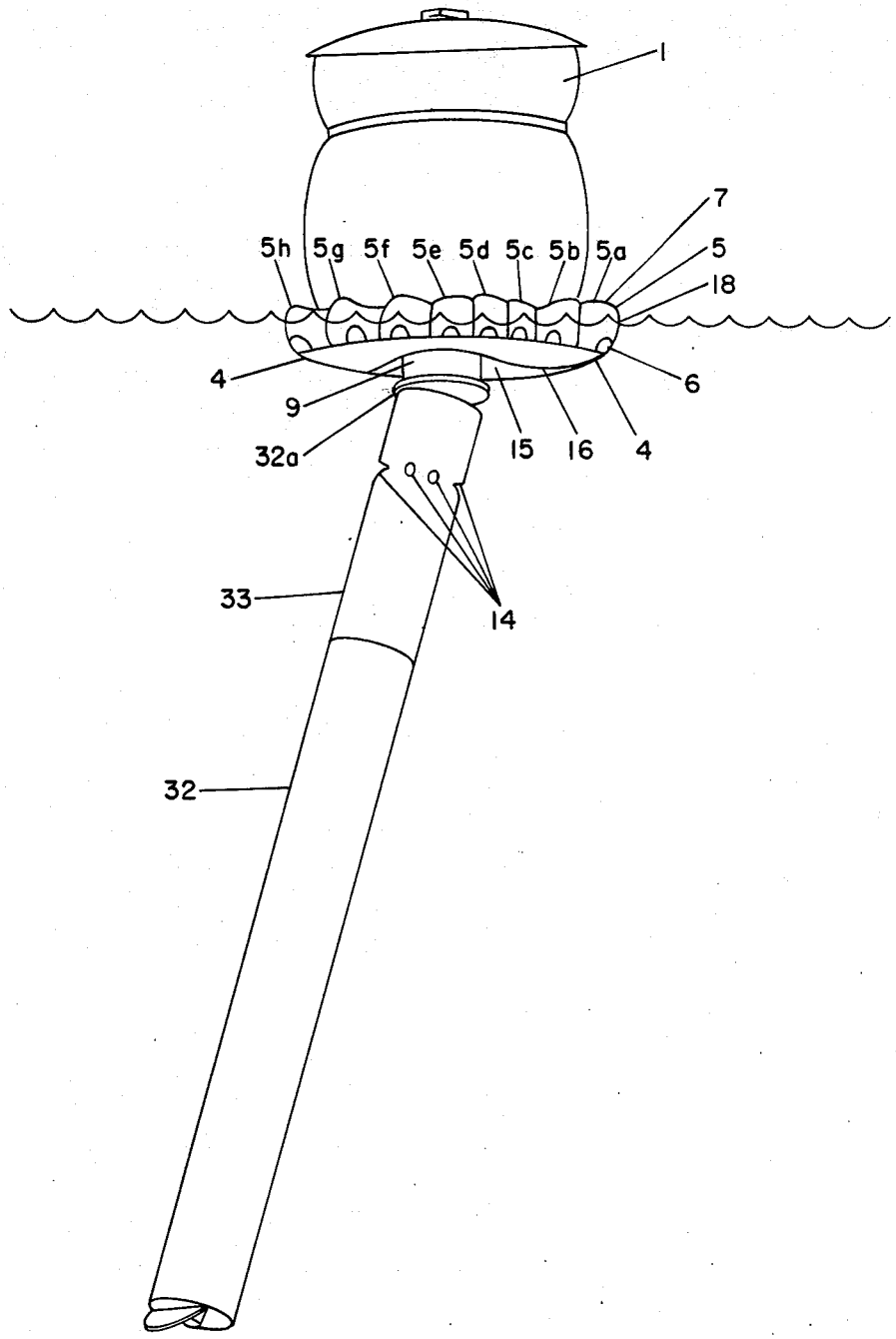
FIG. 1 is a side view of a communications bouy according to the invention deployed in water.
Figure 2:
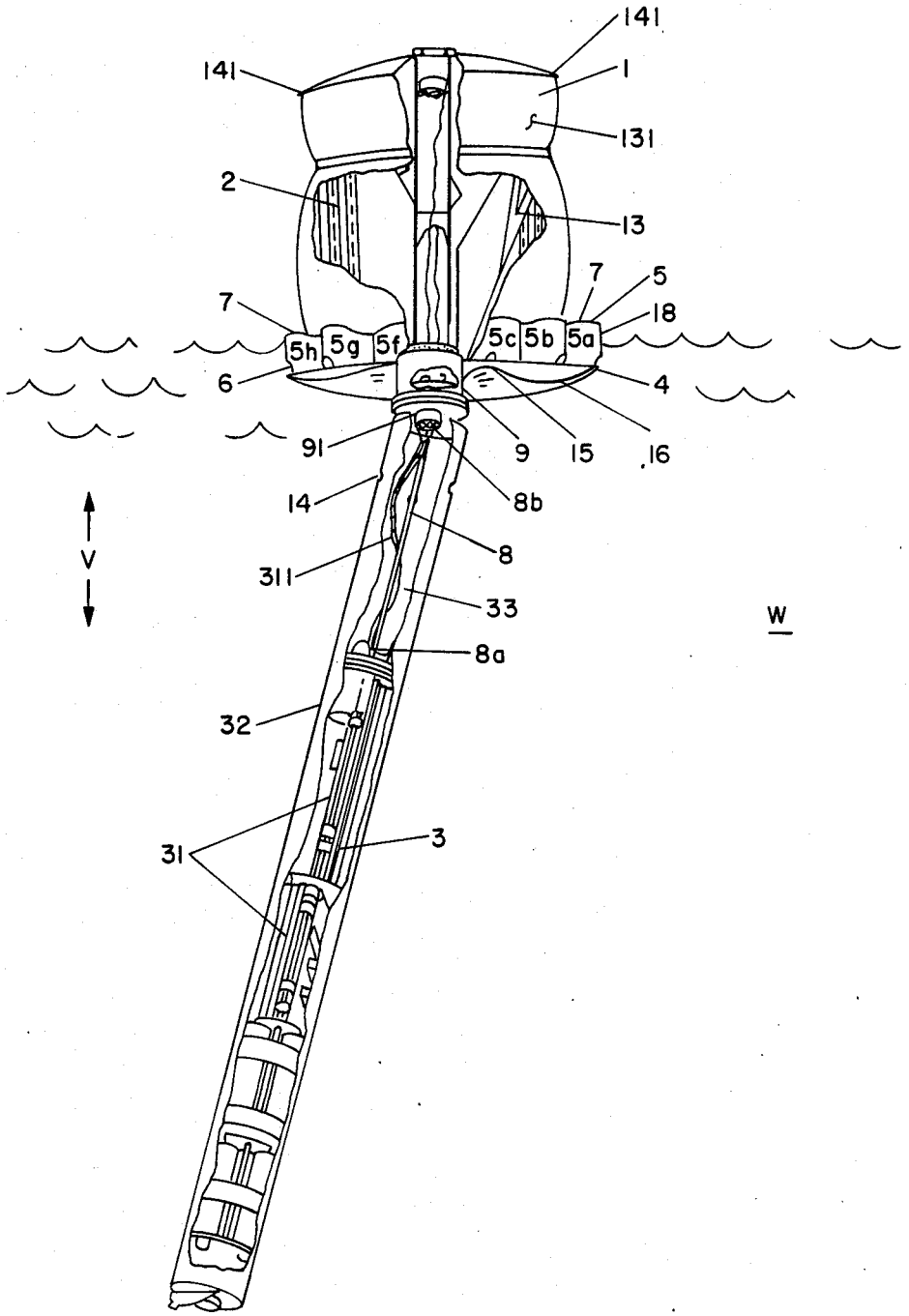
FIG. 2 is a side view of the bouy of FIG. 1 with parts broken away to illustrate internal structure.

Referring to FIGS. 1 and 2, flotation bag 1 is an inflated balloon-like structure having a specific gravity less than the specific gravity of fluid medium W. Bag 1 encloses antenna 2 and supports a payload 3 below the surface of medium W.

Although this embodiment comprises flotation bag 1 which encloses antenna 2, the invention includes flotation devices of any type which support structures.

FIGS. 5*a*–5*g* compare the estimated performance 102 of an antenna such as antenna 3 under varying conditions of heave and pitch with the operational performance requirement 101 for successful transmission. Antenna 3 uses the surface of the fluid W as a ground plane. Heave and pitch disturb the relationship between the radiating antenna 3 and the ground plane, changing the radiation pattern of antenna 3. As shown by graphs 5*a*, 5*b*, and 5*f*, the estimated performance 102 of antenna 3 crosses and falls below the oepational performance requirements for successful transmission between points 103 and 104. In summary, successful transmission is not achieved when antenna 3 undergoes more than 4 inches heave or 25° pitch. The apparatus according to the invention limits the motion of the antenna relative to the ground plane to within 4 inches heave and 25° pitch, under ocean conditions up to sea state 5.

A damper skirt 4 extends around the base of the flotation bag 1 and is made of a semi-rigid material supported in a horizontal position by ribbon fence 5.

When the apparatus is afloat, damper skirt 4 is below the surface of the medium W. The weight of the payload 3, the shape of the bottom of the flotation bag 1 and the bouyancy of bag 1, which will be described in detail below, are configured so that damper skirt 4 is below the water line when the apparatus is stable.

Damper skirt 4 increases the surface area in contact with the ocean, offering a surface which resists motion V within medium W. In order to rise or tip in response to a wave, damper skirt 4 must travel upwardly through the fluid. The resistance to upward movement of skirt 4 is caused by the fluid above the skirt 4. The energy that would otherwise cause heave and pitch of the flotation bag 1 is dissipated by this resistance and any resulting movement of skirt 4 within the medium W.

Figure 4:
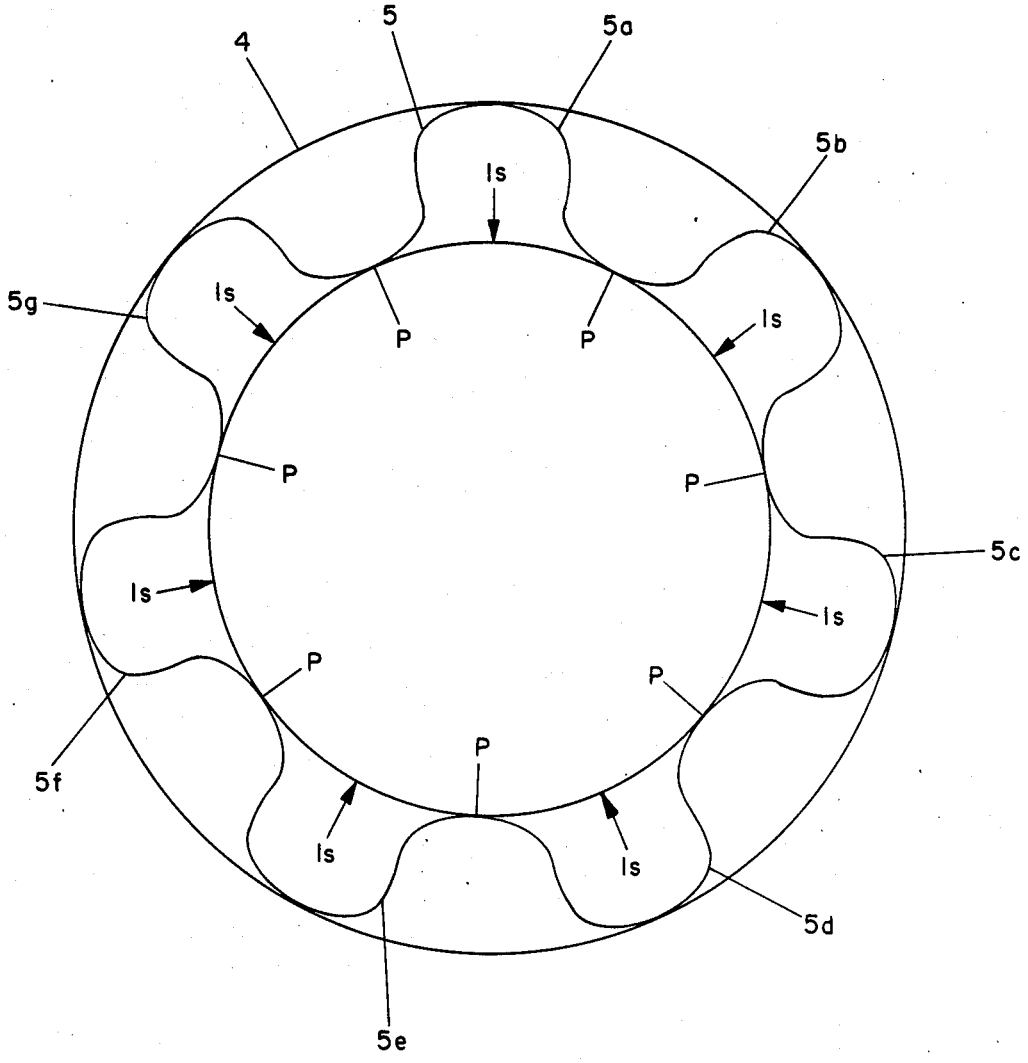
FIG. 4 is a top view of a flotation bag according to the invention.
Figure 5A:
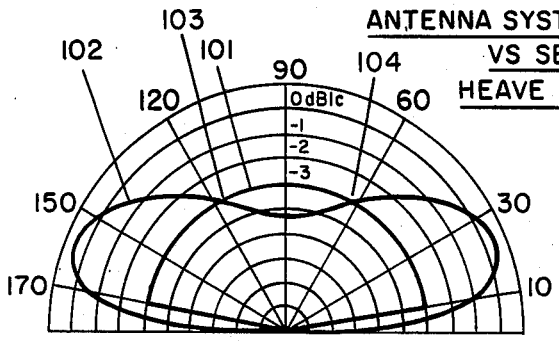
FIGS. 5*a*–5*g* are graphs illustrating the operational transmission requirements and the estimated performance of an antenna system according to the invention under varying conditions of heave and pitch.
Figure 5B:
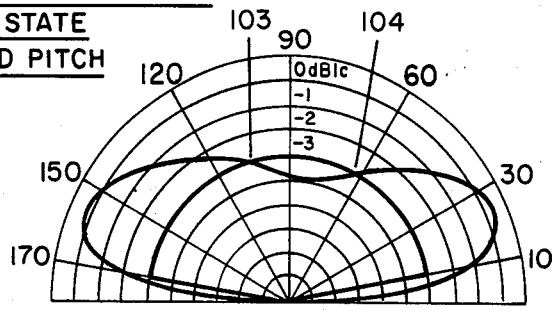
Figure 5C:
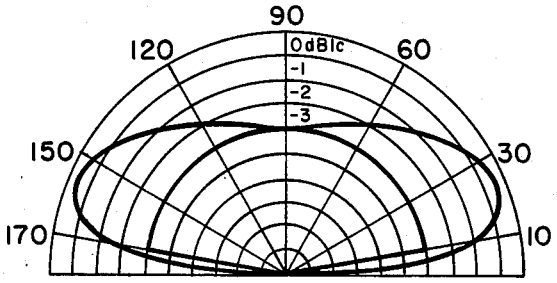
Figure 5D:
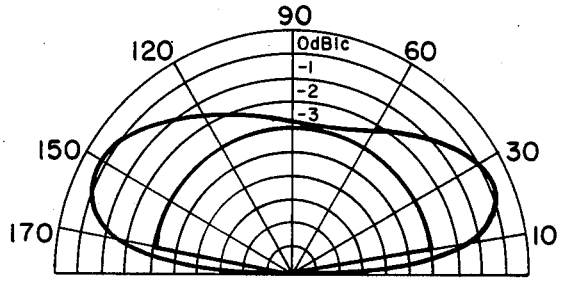
Figure 5E:
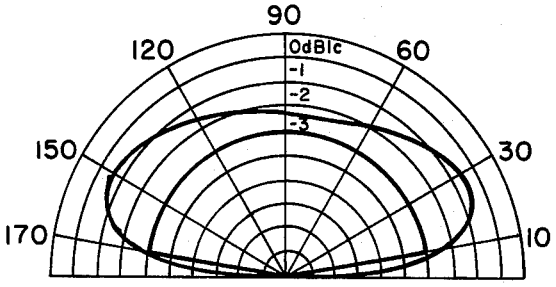
Figure 5F:
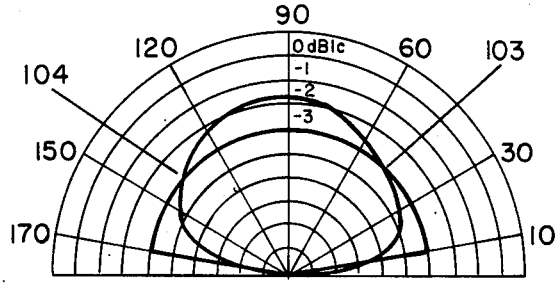
Figure 5G:
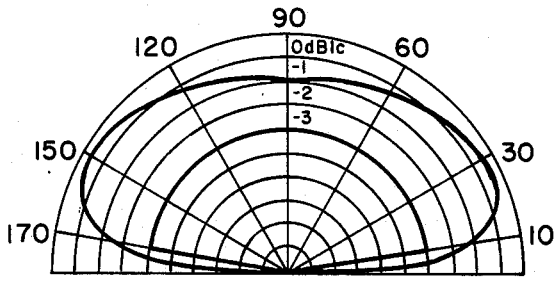

As shown particularly in FIG. 4, ribbon fence 5 which supports the damper skirt 4 is a series of contiguous compartments, 5*a*–5*g*. Damper skirt 4 acts as the base of the compartments 5*a*–5*g* of ribbon fence 5 and the side 1*s* of the flotation bag 1 forms the back wall of the compartments. The walls of the compartments in the embodiment illustrated comprise a strip of semi-rigid material connected to the side of the flotation bag 1 at spaced apart points P. The flotation bag 1, damper skirt 4 and the strip form the continguous compartments, the combination of which is referred to herein as ribbon fence 5.

Each compartment 5*a*–5*g* has an opening 6 in the lower portion thereof, where the strip joins to damper skirt 4. The compartments have an opened top 7. When stable in the ocean, the bottom hole 6, which has a cross section less than the opening at the top 7, is beneath the level of the medium W. The water line on the flotation bag when the apparatus is at rest in the ocean is approximately at the midpoint 8 of the height of the ribbon fence 5.

Compartments 5*a*–5*h* act as containers for the fluid medium. Fluid encroaching upon bag 1 can enter the compartments through hole 6 or the opened top 7 and can drain from the compartments through the hole 6. When bag 1 rises due to the motion of the ocean, sea water will drain out of the holes 6, dissipating the kinetic energy of bag 1 created by the rising motion of the ocean. Oscillating of the flotation bag 1 within the medium W are thereby damped. The compartments increase the resistance to motion of damper skirt 4 by partially enclosing the fluid and by requiring the damper skirt to lift the partially enclosed fluid in the compartments as the flotation bag 1 rises in response to a wave. This acts to further decrease the heave and pitch of the flotation bag.

The damper skirt 4 and ribbon fence 5 are described associated with each other, constructed from semi-rigid materials for the purpose of stabilizing flotation bag 1. However, the damper skirt 4 may be a submerged plate and the means for channeling fluid that encroaches on the device. Such structures may be used separately or in combination to decrease both the heave and pitch of the device.

Payload 3 comprises electronics 31 enclosed in a cylindrical housing 32. Housing 32 is connected to the bottom of the flotation bag 1 by nylon cord 8. One end of nylon cord 8 connects to a point 8*a* within the housing, approximately one-quarter from the top of the housing and the other end connects to the center 15 of the damper skirt 4 of the bag 8*b*, at bulkhead 9, which is a rigid portion. Electrical wires 311 also pass from the electronics 31 into the bulkhead 9. Beneath the bulkhead 9 is microphonics bumper 91.

Nylon cord 8 and the location of the connection between the housing 32 and the flotation bag 1, at 8*a* and 8*b*, decouple the motion of flotation bag 1 from housing 32 such that, over a certain range, the motion of bag 1 does not affect the motion of cylindrical housing 32 and the motion of cylindrical housing 32 does not affect the housing motion of bag 1. The range of motion depends on the demensions of the decoupling apparatus including the diameter of housing 32 and the distance between the top of housing 32 and microphonic bumper 91.

Housing 32 is free to swing like a pendulum until the top of the housing 32*a* collides with the microphonic bumper 91. Similarly, the flotation bag 1 can freely pitch until the bumper 91 colides with the top of the housing 32*a*.

This allows for 10°–15° of motion of the payload 3, measured from the vertical, before contact between housing 32*a* and microphonic bumper 91. Bumper 91 absorbs some of the energy of any impact between bag 1 and payload 3, decreasing the effect such impact would have on the heave and pitch of the flotation bag. Bumper 91 also protects the electrical wiring that feed to the antenna, preventing interruption or interference with the transmission of a message due to impacts between the housing 32*a* and the bulkhead 9 through which wires 311 pass.

In the embodiment illustrated, electronics 31 is close to antenna 2 in order to minimize the power loss due to transmission of a signal from electronics 31 to antenna 2 via cable 311. Preferably, the power loss is less than 3 db.

Figure 3:
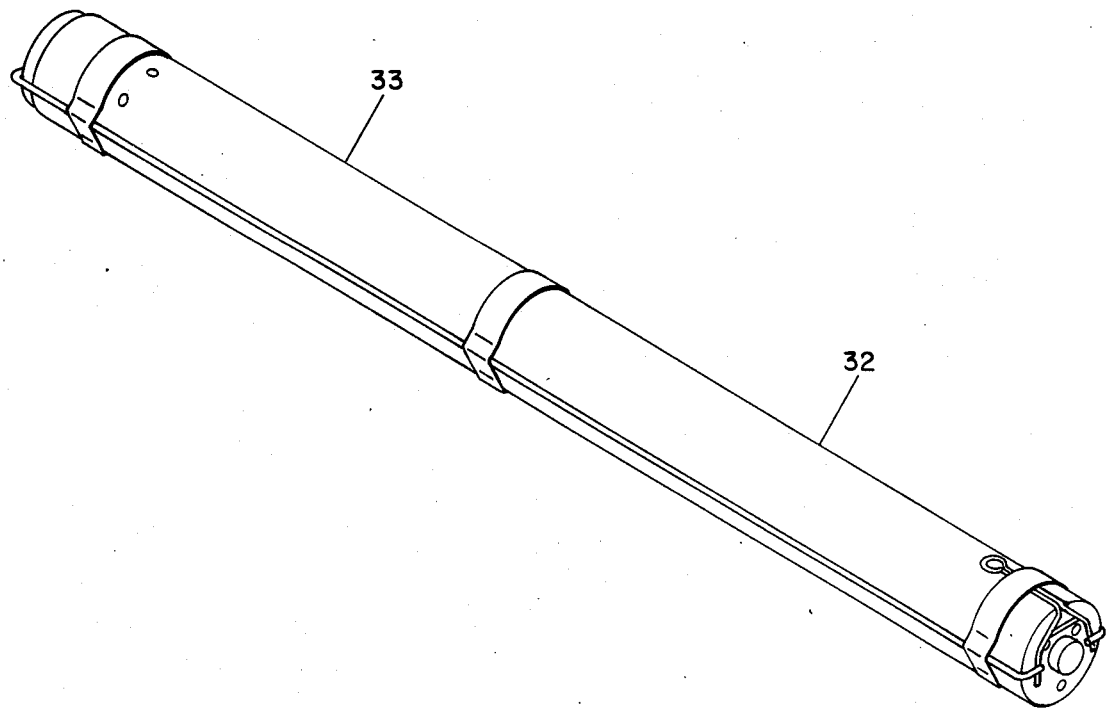
FIG. 3 is a perspective view of a communications bouy according to the invention in an undeployed state.

The upper portion 33, of housing 32, referred to herein as a collar, stores the entire flotation apparatus before it is deployed, as shown in FIG. 3. After deployment, the upper portion 33 floods with water, through holes 121 in its sides, as shown in FIGS. 1 and 2. The flooding reduces the bouyancy of the payload 3 which results in payload 3 pulling the flotation bag 1 into the water, ensuring that the damper skirt 4 and bottom hole 6 of ribbon fence 5 are submerged. This increases the stability of flotation bag 1.

The flooding of upper portion 33 results in the center of mass of housing 32 being lower in the medium W, increasing the period of oscillation of housing 32. This stabilizes the entire structure and decreases the heave and pitch of flotation bag 1.

The center of the bottom of the flotation bag 1 is pulled upward by straps 13 secured at 131, along the inside wall of flotation bag 1. This reduces the bouyancy of bag 1, aiding in maintaining the necessary waterline above damper skirt 4 and at the midpoint of ribbon fence 5. The base of bag 16 is inwardly arched at its center 15 so that the greatest bouyant forces are located at the outer portions of the bag 16. This decreases the pitch of the flotation bag 1 by creating a longer torque arm which must be overcome for the flotation bag to rotate. This righting momemt further aids in stabilizing the flotation bag. The adhesion caused by inwardly arched center 15 between the surface of the bottom 16 of the bag and the fluid medium W also decreases the heave of the flotation bag.

Although this particular embodiment describes a flotation bag with a concave bottom, the invention is meant to cover flotation devices of any material with a bottom of inwardly arched shape.

The apparatus and payload are ejected in the cylindrical housing 3, as shown in FIG. 3. Antenna 4, flotation bag 1, ribbon fence 5 and damper skirt 4 are all stored in upper chamber 33 of the housing 32. Housing 32, which is bouyant, floats to the surface of the ocean after being ejected. The flotation bag and antenna are then deployed and the preprogrammed messages are transmitted.

While this flotation device has been described with regard to a communications buoy for submarines, the device can be used for any purpose which requires a very stable flotation device. The scope of the invention is disclosed in the attached claims.

What is claimed is:

1. An apparatus for the stable support of a structure, such as an antenna, in a fluid medium, such as water, said apparatus comprising:

a. a buoyant first member having a side wall, said first member having a buoyancy greater than the buoyancy of the medium so that said member, when located in the medium, will float and a lower portion of said member will be submerged;

b. first means attached to the lower portion of said first member, said first means engaging the structure;

c. a ribbon fence attached to the side wall, said ribbon fence comprising at least one container with a top opening, a side opening and a closed bottom, said container supported by the side wall of the buoyant first member such that the top opening is above the level of a fluid medium and the lower opening is below the level of a fluid medium when the apparatus is floating in the medium;

d. said ribbon fence positioned on the side wall such that fluid which encroaches upon the side wall due to motion between the buoyant member and the fluid medium enters the top opening whereupon it is temporarily stored in the container and dissipates its kenetic energy and thereafter exits the container through the side opening.

2. An apparatus as in claim 1, wherein said ribbon fence comprises a plurality of adjacent compartments supported by and located about the side wall, each compartment having an open top, a side opening having a cross sectional area less than the cross sectional area of the top opening and a closed bottom.

3. An apparatus as in claim 2, wherein each said compartment comprises the side wall, a substantially vertical wall having sides attached to the side wall and having the side opening therein and wherein all of said closed bottoms form a concave, semi-rigid disk attached to the bottom of the buoyant member and the bottom edges of all of the vertical walls, said disk being submerged within the medium and impeding the motion of the apparatus with respect to the medium, thereby decreasing the heave and pitch to which the buoyant member is subject due to movement of the medium.

4. An apparatus as in claim 1 further comprising a payload and decoupling menas attached to the underside of the buoyant member and supporting the payload below the buoyant member such that motion of the payload within a given range is decoupled from the member and motion of the member within a given range is decoupled from the payload.

5. An apparatus as in claim 4 wherein the payload includes a housing and said decoupling means is a flexible member interconnecting the housing and the bouyant member.

6. An apparatus as in claim 5 further comprising:

a. a collar extending from the housing and surrounding the flexible member;

b. a rigid portion supported by the underside of the buoyant first member, said flexible member connected to said rigid portion;

c. a bumper supported by said rigid portion and engaging the collar when the pivotal movement of the housing with respect to the rigid portion is greater than a predetermined angle within the given range.

7. An apparatus as in claim 6 wherein said bumper is a microphonics bumper and the predetermined angle is approximately 10°.

8. An apparatus as in claim 7 wherein said housing includes a chamber within which said buoyant member is stored when the apparatus is in an undeployed state, said chamber being flooded after the apparatus is deployed in the fluid medium.

9. An apparatus as in claim 8 wherein the bouyant member is a flotation bag having straps connected to the inside walls of the bag and the center of the bottom of the bag, pulling the center of the bottom of the bag inward, forming the concave shape.

10. An apparatus as in claim 9 further comprising an antenna supported by said bouyant member, first means for generating an r.f. signal included in said payload and means interconnecting said antenna and said first means.

11. An apparatus for the stable support of a structure, such as an antenna, in a fluid medium, such as water, said apparatus comprising:

a. a buoyant first member for supporting the structure;

b. a housing carrying a payload;

c. decoupling means for supporting the payload below the buoyant member such that motion of the payload within a given range is decoupled from the member and motion of the member within the given range is decoupled from the payload, said decoupling means comprising a flexible member interconnecting the housing and the buoyant member; and d. a collar supported by said housing and surrounding substantially the entire length of the flexible member.

12. An apparatus as in claim 11 wherein:

a. a center rigid portion forming a damper skirt comprises an underside of the bouyant first member;

b. said flexible member connects to said rigid portion; and c. said rigid portion has a bumper for engaging the collar when the pivotal movement of the housing with respect to the rigid portion is greater than a predetermined angle within the given range.

13. An apparatus as in claim 12 wherein the predetermined angle is approximately 10° and said collar forms a chamber within which said member is stored before it is deployed whereby the chamber is flooded after the apparatus is deployed in the fluid medium.

14. An apparatus as in claim 11 wherein the buoyant member is a flotation bag having straps connected to the inside walls of the bag and the center of the bottom of the bag, pulling the center of the bottom of the bag inward, forming a bottom having a concave shape.

15. An apparatus as in claim 11 further comprising an antenna supported by said bouyant member, first means for generating an r.f. signal included in said payload and means interconnecting said antenna and said first means.

16. A communications bouy which is stable in a fluid medium, and which includes structure for minimizing the heave and pitch of the bouy, said bouy comprising:

a. an antenna, b. a flotation bag with a concave bottom formed by pulling in the center of the bottom of the bag with straps secured to the inside walls of the bag, said bag supporting said antenna, c. a semi-rigid damper skirt extending around the base of the bag, which is submerged when the apparatus is floating in the fluid medium;

d. a ribbon fence comprising containers with an opening above the fluid level, and an opening below the fluid level, when the apparatus is floating in the medium, allowing the fluid to flow in and out of the containers;

e. a damper skirt associated with said bag for impeding the heaving and pitching motion of the flotation bag, said containers supporting the damper skirt in a substantially horizontal position, f. a payload including first means for generating an r.f. signal, g. a longitudinal, cylindrical housing for supporting the payload, said housing having a floodable chamber, said housing connected to a rigid portion of the flotation bag by a flexible cable surrounded by said chamber, enabling the housing to swing.

17. The bouy of claim 16 wherein said bag supports said antenna above the surface of the fluid medium such that the surface of the fluid medium functions as a ground plane with respect to the antenna when the antenna is radiating due to r.f. excitations from the first means.

* * * * *